US007036255B1

(12) United States Patent
Santana et al.

(10) Patent No.: US 7,036,255 B1
(45) Date of Patent: May 2, 2006

(54) DISPLAY SIGN POST

(75) Inventors: Nicholas J. Santana, Palmdale, CA (US); Kenneth K. Terracciano, Lancaster, CA (US)

(73) Assignee: Real Designsigns. Inc., Lancaster, CA (US)

( * ) Notice: Subject to any disclaimer, the term of this patent is extended or adjusted under 35 U.S.C. 154(b) by 0 days.

(21) Appl. No.: 11/074,193

(22) Filed: Mar. 5, 2005

(51) Int. Cl.
*G09F 15/02* (2006.01)

(52) U.S. Cl. ..... 40/607.09; 40/607.04; 40/607.08; 40/541; 40/606.19; D20/41

(58) Field of Classification Search ..... 40/607.04, 40/607.08, 607.09, 541, 560, 559, 606.15, 40/611.12, 611.04, 611.05; 362/812; D20/10, D20/41
See application file for complete search history.

(56) References Cited

U.S. PATENT DOCUMENTS 1,853,523 A * 4/1932 Titman ..... 40/559
4,258,494 A * 3/1981 Borque ..... 40/606.19
4,327,514 A * 5/1982 Bourque ..... 40/607.06
D300,374 S * 3/1989 Dziurman ..... D26/68
4,843,746 A * 7/1989 DesNoyers et al. ..... 40/607.04
4,910,901 A * 3/1990 Boyar ..... 40/607.06
5,467,076 A * 11/1995 Ruocco et al. ..... 340/571
D367,078 S * 2/1996 Oakley ..... D20/41
5,502,910 A * 4/1996 Lucchesi ..... 40/607.06
5,903,991 A * 5/1999 Sasse ..... 40/607.04
6,003,255 A * 12/1999 Mahoney et al. ..... 40/611.05
6,318,011 B1 * 11/2001 McCudden ..... 40/607.1
6,604,840 B1 * 8/2003 Watson ..... 362/249
6,910,664 B1 * 6/2005 Bolinder et al. ..... 248/156

* cited by examiner

*Primary Examiner*—Gary C. Hoge
(74) *Attorney, Agent, or Firm*—Roger Marrs

(57) ABSTRACT

A display sign having a support post with an anchoring device at the bottom end suitable for burying in the ground. A curved cantilevered arm is detachably connected to the support post and outwardly extends in a lateral direction. A curved frame is detachably connected between a distal end of the arm and the upper portion of the support post for holding and integrally securing a sign to the arm and post. An additional sign holder is placed on top of the arm insertably receiving and displaying additional information. The frame is detachably connected between the arm and the support post so that the display sign can be readily changed. The anchoring device includes a flanged arrangement which resists twisting of the post and tilting of the post when it is buried in the ground. Illumination means is provided for lighting the sign and a power supply, such as a solar collector, is provided.

8 Claims, 1 Drawing Sheet

SOLD
FOR SALE
QUICK REALTY
767-7676

DISPLAY SIGN POST

BACKGROUND OF THE INVENTION

1. Field of the Invention

The present invention relates to the field of display sign posts, and more particularly to a novel sign post having improved anchoring means and a detachable assembly for quick changing of display signs and which includes provision for sign illumination having solar energy collecting means.

2. Brief Description of the Prior Art

In the past, it has been the conventional practice to display signs or other pictorial subject matter, such as used in the real estate industry, which are detachably connected to an arm that is outwardly projecting from a support post. The sign is usually downwardly depending from hooks or other supports which allow for sign replacement as well as for ready assembly and disassembly. Some prior sign posts include illumination means which are carried on the arm and are directed at the front and rear faces of the sign. A power supply is sometimes employed which uses solar collectors for energizing batteries or directly energizing lights.

Problems and difficulties have been encountered with such prior art sign posts which stem largely from the fact that the sign being displayed is not integral with the post and is not fixedly secured to the arm or the post and may be readily disassembled by vandals or even by environmental conditions, such as windage or the like. Furthermore with respect to illumination, energizing of the illumination means raises problems since exposure of light bulbs to the environmental element and to vandals is unsatisfactory since the sign can be defaced and the illumination means put out of commission. Even when a solar collector is used in prior art sign posts, the collection of sun rays is directional and does not take advantage of sun movement throughout the day.

Perhaps one of the more difficult problems resides in maintaining the post in an upright position in spite of environmental conditions. Even though the bottom of the support post is buried, the weight of the sign and the laterally extending arm may cause the post to lean so that the sign assembly and post is not upright. Also, the prior display signs include a post that may be easily twisted while buried which again loosens the ground support for the sign and the post so that it will tilt or tip away from vertical orientation. Leaning or tilting of the sign detracts from its effectiveness and, in some instances, the post is so unstable that it will fall and lie on the ground.

Therefore, a long-standing need has existed to provide a display sign post having a sign that is readily changeable and which includes an anchoring means for preventing twisting or tilting of the support post when buried in the ground. Also, such a novel display sign should include means for energizing a lighting system which incorporates either LED's or fiber optics for illumination.

SUMMARY OF THE INVENTION

Accordingly, the above problems and difficulties are avoided by the present invention which provides a novel display sign having an elongated support post with an anchoring means at the bottom end suitable for burying in the ground. A curved cantilevered arm is detachably connected to the support post that outwardly extends in a lateral direction from the support post. A curved frame is detachably connected between the distal end of the arm and the upper portion of the support post for holding and integrally securing a sign to the arm and post. An additional sign holder is placed on top of the arm for insertably receiving and displaying additional information. The frame is detachably connected between the arm and the support post so that the display sign can be readily changed. The base of the support post includes a flanged arrangement which resists twisting of the post and tilting of the post when it is buried in the ground. Illumination means is provided for lighting the sign which may include LED's or integral optical fibers and a supply of energy is by battery means or directly connected to a solar collector which may be adjusted to follow the travel of the sun.

Therefore, it is among the primary objects of the present invention to provide a novel display sign post that has a novel anchoring means for preventing twisting or tilting of the sign once the end of the support post is buried in the ground.

Another object of the invention is to provide a novel quick-change assembly for a display sign so that replacement or alternate signs can be readily substituted.

A further object of the invention is to provide a detachable frame for holding a sign to a support post which maintains the sign in a rigid position and is fully supported by the support post.

Still another object is to provide an illumination means for a display sign that receives its energy from a solar collector and is applied to both sides of the sign by means of either LED's or fiber optics.

Yet another object resides in providing an integral mounting of a sign with a support post so that there is an absence of movement therebetween.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF PREFERRED EMBODIMENT

Figures 1, 2, 3, 4, 5:
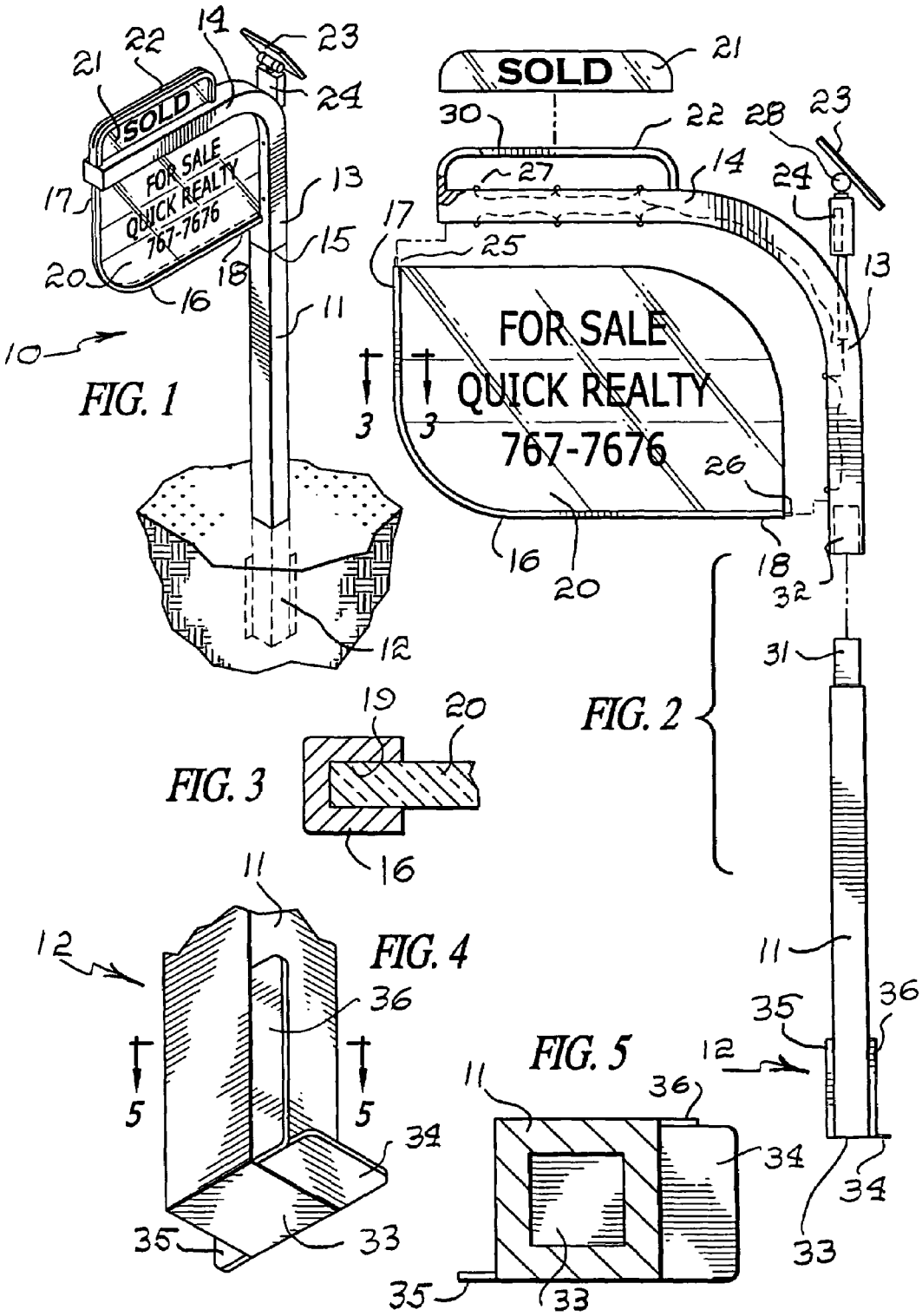
FIG. 1 is a perspective view showing the novel display sign post incorporating the present invention.
FIG. 2 is an exploded side elevational view showing the display sign post illustrated in FIG. 1.
FIG. 3 is an enlarged fragmentary view taken in the direction of arrows 3—3 of FIG. 2.
FIG. 4 is a bottom fragmentary perspective view of the anchoring means employed on the support post as shown in FIGS. 1–2 inclusive.
FIG. 5 is a transverse cross-sectional view of the support post anchoring means shown in FIG. 4 as taken in the direction of arrows 5—5 thereof.

Referring to FIG. 1, the novel display sign post is indicated in the general direction of arrow 10 which includes an elongated post 11 having an anchoring means 12 at its lower end and an arcuate sign support 13, which includes a cantilevered and outwardly extending arm 14. The sign support 13 is detachably connected to the top end of the support post 11 and a parting line is indicated by numeral 15.

The sign support further includes a curved frame 16 having opposite ends 17 and 18 which are detachably connectable with the support arm. The frame 16 mounts a suitable sign 20 which displays selected indicia, graphic representations or pictorial subject matter on either or both sides thereof. The indicia may be magnetically attached. Furthermore, the outwardly projecting arm 14 further supports an auxiliary sign 21 within an upper frame 22 which sign may be magnetically held in place. It is to be particularly understood that the signs 20 and 21 may be readily removed and replaced or changed for other display media or signs. A solar collector 23 is pivotally carried on a battery pack 24 which is connected to an illumination means on the arm 14 or within the sign 20 per se.

Referring now in detail to FIG. 2, it can be seen that the frame 16 is detachably connected to the inside of the sign support 13 and to the underside of arm 14. End 17 of the frame includes a permanent weld, or a screw or fastener 25, that is in securement with the underside of the distal end of arm 14 while end 18 of the frame includes a permanent weld or a pin 26 that is inserted into a hole in the sign support 13. It can also be seen in FIG. 2, that the solar collector 23 and battery pack 24 is operably connected to an illumination means which may take the form of a plurality of LED's as indicated by numeral 27, or if desired, the sign 20 may be provided with fiber optics which derive their energy from the battery pack 24. The solar collector 23 is supported on a pivot 28 so that the face of the solar collector may follow the sun in response to a motorized device or it can be manually set at the selection of the user.

The sign 21 may be inserted into or taken from the frame 22 via a slot 30 while the sign support 13 may be detachably connected to the top of post 11 by means of a plug 31 insertably received within a cavity 32 on the underside of the support arm 13.

It is to be particularly noted that the anchoring means 12 includes a plate 33 which includes a transverse portion extending beyond the post 11 so that when buried, the plate 33 prevents tilting of the post which might otherwise occur due to at least the weight of the sign and sign arm 14. Twisting of the post is prevented by side flanges 35 and 36.

In FIG. 3, it can be seen that the edge marginal region of sign 20 is retained within the frame 16 by insertion into a groove 19 on the inside of the frame 16. The frame may be detachably or permanently connected to the edge marginal region of the sign so that the sign may be changed or other signs may be substituted therefor.

Referring now in detail to FIGS. 4 and 5, it can be seen that the plate 33 includes an outwardly projecting portion 34 that extends beyond the dimension of the post 11. The provision of this flange prevents tilting of the post when the anchor means is embedded in the ground. Also, flanges 35 and 36 which are elongated and extend outwardly from opposite sides of the post 11 to prevent twisting of the post when it is buried in the ground.

In view of the foregoing, it can be seen that the novel display sign post of the present invention provides a means for inter-changing the sign 20 as well as for changing the sign 21. Also, the signs are illuminated either by LED's or by fiber optic arrangements and energy thereto is supplied from the solar collector 23. The display sign post is readily detachable such as the post 11 from the sign support 13 as well as the signs and the frame from the sign support so that the entire assembly can be placed into a bag or other container and easily stored in the trunk of a car or in the cargo area of any vehicle. Twisting and tilting of the post once the anchor means 12 has been buried in the ground is prevented by the flanges 35 and 36 as well as the flange 34.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A display sign apparatus comprising:

an elongated support post having a lower end adapted to be buried in earth and an upper end terminating with a connector;

an arcuate arm having an end coupled with said connector and an outwardly extending portion;

a frame connected between said arcuate arm end and said outwardly extending portion; and a display panel held in said frame against said arcuate arm.

2. The display sign apparatus defined in claim 1 including:

display indicia carried on said display panel.

3. The display sign apparatus defined in claim 2 wherein:

said indicia is magnetically attached to said display panel.

4. The display sign apparatus defined in claim 2 including:

a secondary frame mounted on top of said arcuate arm for insertably receiving a second display panel.

5. The display sign apparatus defined in claim 4 including:

anchor means secured to said lower end of said post for preventing twisting, tilting or leaning of said support post when buried in earth.

6. The display sign apparatus defined in claim 5 including:

illumination means carried on said arcuate arm; and a power supply mounted on said arcuate arm and connected to said illumination means.

7. The display sign apparatus defined in claim 6 wherein:

said anchor means includes a first flange horizontally carried on said lower end and a second flange carried vertically on said lower end whereby said first flange and said second flange are normal with respect to each other.

8. The display sign apparatus defined in claim 7 wherein:

said illumination means is a panel of solar cells operably coupled to a plurality of LED's carried on said arcuate arm directed to illuminate said indicia.

* * * * *